US006072938A

United States Patent [19]

Peterson et al.

[11] Patent Number: 6,072,938

[45] Date of Patent: Jun. 6, 2000

[54] HEATER WITH MEDIUM-FILLED PASSIVE HEATING ELEMENT

[75] Inventors: John W. Peterson, Hawthorn Woods; Chris Heflin, Oak Park, both of Ill.

[73] Assignee: Lakewood Engineering and Manufacturing Company, Chicago, Ill.

[21] Appl. No.: 09/134,119

[22] Filed: Aug. 14, 1998

[51] Int. Cl.[7] ..... F22B 7/06

[52] U.S. Cl. ..... 392/343; 392/347

[58] Field of Search ..... 392/343, 347, 392/358, 360, 370, 374, 377; 219/530

[56] References Cited

U.S. PATENT DOCUMENTS

| | | | |
|---|---|---|---|
| 2,268,361 | 12/1941 | Walker | 165/82 |
| 2,530,806 | 11/1950 | Boxrud . | |
| 2,683,209 | 7/1954 | Beckjord | 392/374 |
| 3,283,125 | 11/1966 | Snelling | 392/353 |
| 3,293,409 | 12/1966 | Snelling | 392/352 |
| 3,356,828 | 12/1967 | Furness | 392/344 |
| 3,532,856 | 10/1970 | Collins . | |
| 3,548,159 | 12/1970 | Ellstroem . | |
| 4,117,308 | 9/1978 | Boggs et al. | 392/360 |
| 4,124,794 | 11/1978 | Eder | 219/530 |
| 4,227,068 | 10/1980 | Carter | 392/370 |
| 4,567,351 | 1/1986 | Kitagawa et al. | 392/377 |
| 4,870,253 | 9/1989 | De'Longhi | 392/358 |
| 4,904,846 | 2/1990 | Oscadal . | |
| 5,197,111 | 3/1993 | Mills, II et al. | 392/347 |
| 5,641,420 | 6/1997 | Peterson et al. . | |

*Primary Examiner*—Teresa Walberg
*Assistant Examiner*—Vinod D Patel
*Attorney, Agent, or Firm*—Wallenstein & Wagner, Ltd.

[57] ABSTRACT

There is disclosed an electric heating unit having a housing with air circulation apertures, a heating element, and a passive heat storage member adjacent the heating element. The heat storage member is preferably a sealed chamber containing a heat storage material such as silica or oil. Heat transfer fins surround both the heating element and the heat storage member to facilitate heat transfer to the atmosphere. The heat transfer fins engage the heating element and the heat storage member with gripping collars which may be loosely fitted for installation, and a portion of the collars frictionally engaged with the respective element and storage member to secure the fins into an aligned position. The heat storage member continues to disburse heat to the surrounding atmosphere while the heating element is de-energized, thereby providing a uniform heating source to the room such that fewer energizing and de-energizing cycles of the heating element are required.

25 Claims, 3 Drawing Sheets

HEATER WITH MEDIUM-FILLED PASSIVE HEATING ELEMENT

DESCRIPTION

1. Technical Field

The present invention generally relates to household electric heating units. More specifically, the present invention relates to an improved electric baseboard heating unit for uniformly heating the surrounding atmosphere.

2. Background of the Invention

Electric heating units commonly include various mechanisms for heating the surrounding atmosphere in a room. Conventional electric heaters include various types of radiators which are thermostatically controlled. Such radiators operate on heating cycles. During an energized phase, a heating element is activated and raised to an elevated temperature. An initial spike in the temperature of the heating element occurs, and heat is transferred to the surrounding atmosphere, substantially via radiation. Once a room has been heated to a preset desired temperature, typically identified by a thermostat associated with the heater, the heating element is de-energized and cools relatively rapidly. During this phase, very little residual heat is transferred to the surrounding atmosphere, resulting in the room cooling within a short period of time. Once a preset minimum atmospheric temperature is sensed, the thermostatically controlled radiator again enters the energized phase, providing another spike in the temperature of the heating element, and of the room.

One main disadvantage of such heaters is that a relatively high frequency of energized and de-energized cycles is required in order to maintain the temperature of a room within the desired range. Such frequent cycles results in an unpleasant non-uniform temperature in the room within the preset range, and may cause wear to the heating element and control mechanisms from frequent repeated functions.

Other forms of electric heaters include forced convection heaters which employ a fan to force air flow past the electric heating element. These types of heaters also operate with the same problematic high-cycle heating frequency. Such heaters have the additional disadvantages of increased cost of materials and labor, and additional power must be provided to a fan motor.

Conventional radiating heaters sometimes also employ metal fins which extend from the heating element to facilitate the transfer of heat to the adjacent atmosphere. With these types of conventional heaters, there are problems associated with providing a suitable arrangement and securement of the fins, often requiring costly manufacturing methods and additional materials. For example, U.S. Pat. No. 3,741,291, issued to Limoni on Jun. 26, 1973, discloses a baseboard heater comprising an elongated heating element having a plurality of fins aligned along the heating element. In order to maintain their alignment, several bends are formed at the edges of the fills to form a bridge so that each fin is spaced from, and supported by, an adjacent fin. Also, the fins have an opening surrounding the element which has several fingers which protrude perpendicular to the plane of the fins along the length of the heating element for securing the fins to the element. The fins are further secured by a U-shaped clip attached to the bottom portion of the fins.

Such a construction has several disadvantages. First, extra material is required for the bent portions of the fins and the clip. Second, extra manufacturing steps are required to assemble the structure, including attaching the clip.

Additionally, air flow is impeded by the clip and the bent portions of the fins, resulting in less transfer of heat to the atmosphere that may naturally be available by air passing through the heater. Furthermore, passageway through the fins for inserting the heating element must be closely fit to the outer surface of the heating element in order for the perpendicular fingers to be engaged with the element to securely position the fins. As a result, installing the fins on the heating element is difficult due to frictional resistance.

Therefore, there is a need for a heater having an elongated heating element with heat transfer fins in which air flow is substantially unimpeded, and in which the fins are maintained in an aligned configuration without the need for extra materials or labor. Further, there is a need for an electric heating unit which maintains a room at a more stable, uniform temperature, without employing frequent heating cycles.

SUMMARY OF THE INVENTION

It is an object of the present invention to provide an electric heating unit which is capable of emitting heat at a relatively constant rate over a sustained period of time beyond energizing the electric heating element, thereby maintaining a room at a relatively uniform temperature, without the need for a high heating-cycle frequency.

It is another object of the present invention to provide an electric heating unit having a means for storing heat during an energized phase to disburse heat for a sustained period of time during a de-energized phase of the heater.

It is a further object of the present invention to provide an electric heating unit having an elongated heating element and aligned heat transfer fins in which materials are minimized, manufacturing steps are simplified, and fins are maintained in aligned position without impeding air flow or heat transfer.

It is still a further object of the present invention to provide an electric heating unit for warming atmosphere adjacent the unit, in which the unit has an electric heating element having an electrical current source selectively energized and de-energized. The unit also has a heat storage member positioned adjacent to the electric heating element, the heat storage member being adapted to receive heat from the element and continue to disburse heat to the adjacent atmosphere subsequent to the electric heating element being de-energized.

It is further an object of the present invention to provide an electric heating unit having an elongated heating element, an elongated heat storage member, and heat transfer fins secured in position by gripping collars engaged with the element and the elongated heat storage member, whereby the gripping collars have a shape of different symmetry form the outer dimensions of the element and the storage member such to be secured in position by frictional engagement.

Other features and advantages of the invention will be apparent from the following specification taken in conjunction with the following drawings.

DETAILED DESCRIPTION OF THE PREFERRED EMBODIMENT

Figure 1:
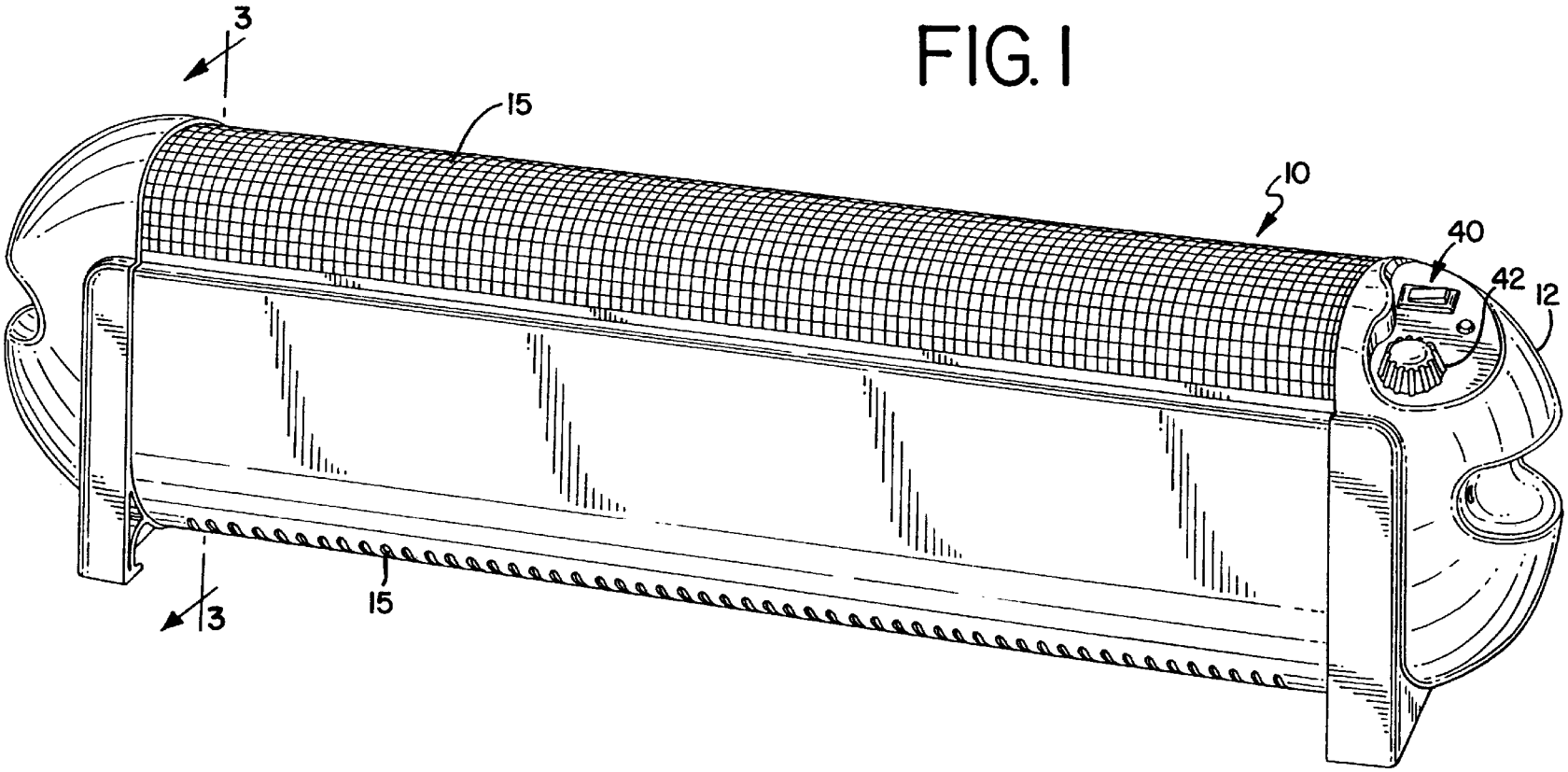
FIG. 1 is a perspective view of an electric heating unit according to the present invention.
Figure 2:
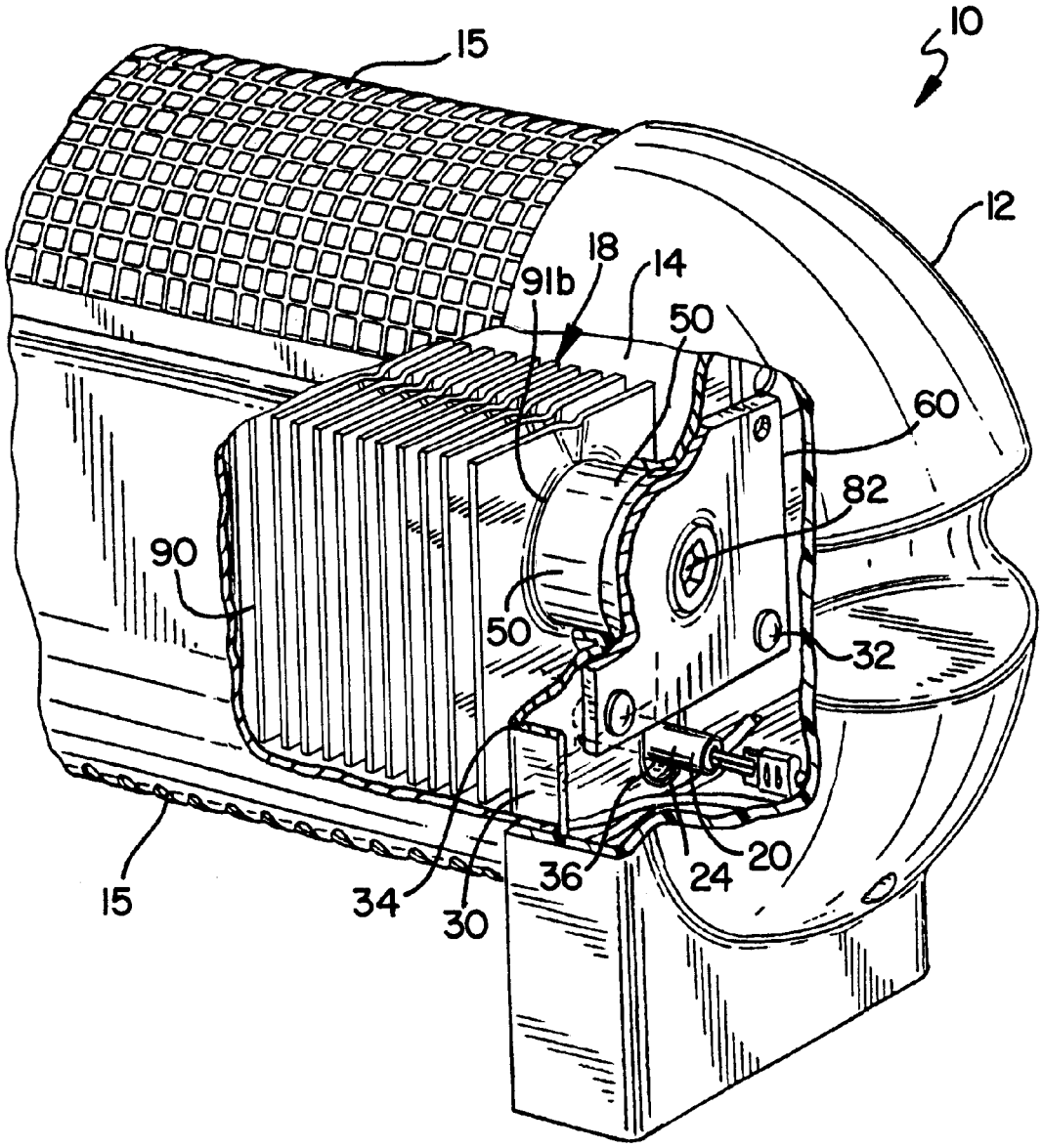
FIG. 2 is a perspective view of the heating unit of FIG. 1, with a portion of the housing cut-away to expose the heating assembly of the present invention.
Figure 3:
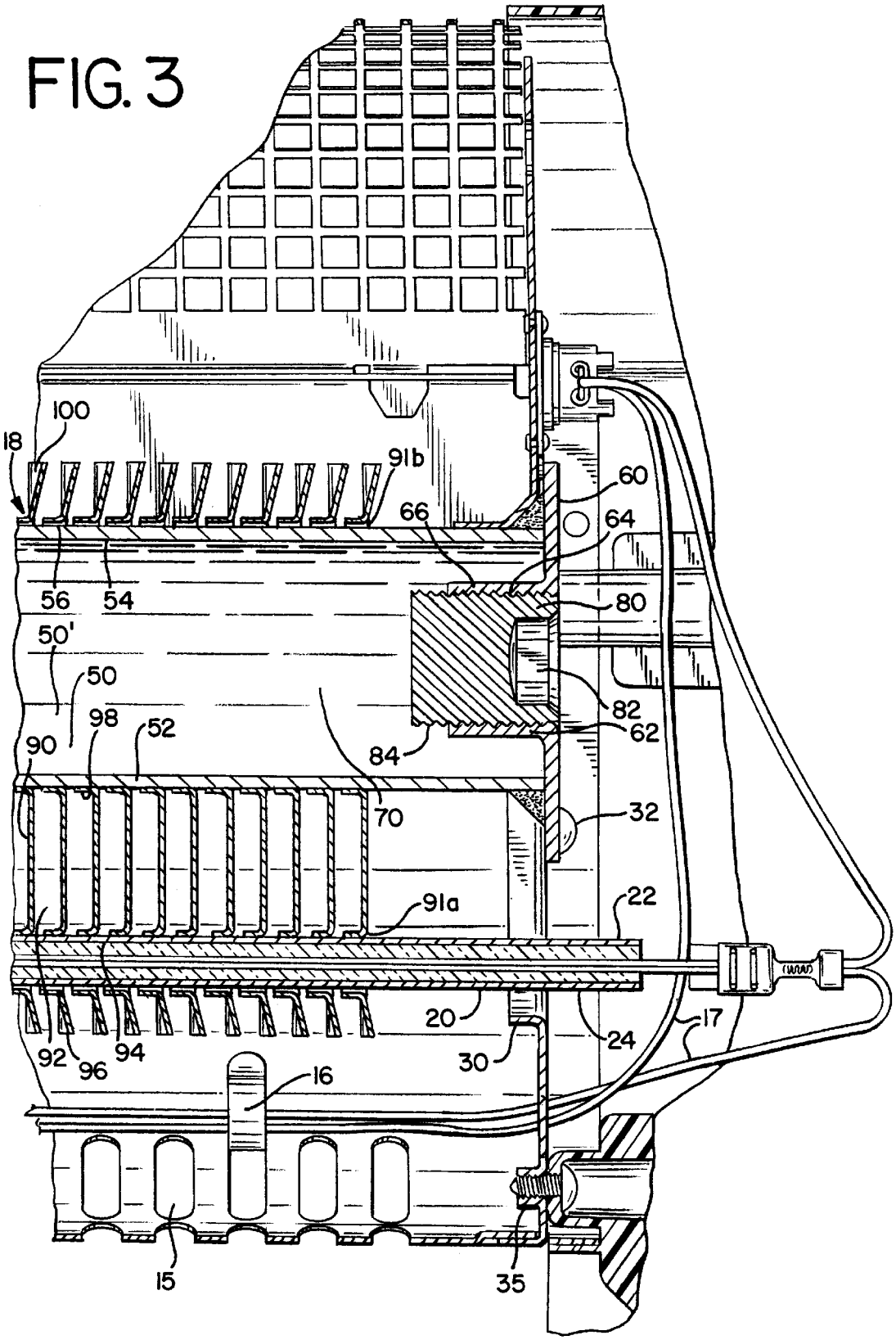
FIG. 3 is a partial cross-sectional view of the heating unit of the present invention.

While this invention is susceptible of embodiments in many different forms, there is shown in the drawings and will herein be described in detail the preferred embodiments of the invention with the understanding that the present disclosure is to be considered as an exemplification of the principles of the invention and is not intended to limit the broad aspect of the invention to the embodiments illustrated.

The electrical heating unit 10 includes a housing 12 having an interior 14 which is in fluid communication with the surrounding atmosphere. The housing 12 preferably includes a plurality of air circulation apertures 15 to allow for air flow and heat transfer between the interior of the housing 14 and the surrounding area. At least one such aperture 15 is preferably formed such that an incized segment 16 of the housing 12 is bent into the interior of the housing 14 to engage a segment of at least one electrical current wire 17, thereby securing the wire 17 to the housing 12.

Inside housing 12, a heating assembly 18, is secured to the interior 14 of housing 12 via at least one mounting bracket or member 30. The heating assembly 18 preferably includes at least an elongated heating element 20, a series of heat transfer fins 90, and an elongated heat storage member 50.

The heating element 20 has an outer heat emitting surface 22 for transferring heat to surrounding areas of the assembly and the adjacent atmosphere. The heating element 20 has an electrical current source and is selectively energized and de-energized by a current controlling means 40 which may be a switch or thermostatic control device. Preferably, an exposed thermostatic control switch 42 is provided to selectively preset the thermostat to a desired temperature setting. A conventional heater thermostat may be employed, which operates to identify a preset temperature range that is selected by the user. Such a thermostat functions to energize the heater element 20 when a preset minimum temperature is present, and de-energizes the element 20 when a preset desired temperature is indicated.

A heat storage member 50 is positioned adjacent heating element 20. As used herein, the term "adjacent" shall denote beside, in direct contact with, or in spaced relation. In this manner, the heat storage member 50 is entirely separate from the element 20, though the element may be touching the member or may be in spaced relation thereto. In an alternative embodiment, the heating element 20 may be arranged as a coil surrounding the heat storage member 50. In each embodiment, the heat storage member 50 receives heat from heating element 20 and attains an elevated temperature while heating element 20 is energized. When heating element 20 is de-energized, the heat storage member 50 continues to disburse heat to the surrounding atmosphere, and gradually decreases in temperature, thereby providing a sustained heating cycle after the element is de-energized, and providing a relatively uniform heating source for the surrounding atmosphere. This structure provides a heating assembly with decreased frequency of energizing and de-energizing cycles necessary to maintain the atmosphere within a preferred, and thermostatically predetermined, temperature range.

Preferably, the heat storage member 50 includes a sealed chamber 50' in spaced relation to heating element 20. Sealed chamber 50' preferably has a substantially continuous side wall 52 having an inner surface 54 and an outer heat receiving surface 56 for receiving heat from heat emitting surface 22 of the element 20. In the preferred embodiment, the sealed chamber 50' is an elongated tubular chamber, with a circular sidewall 52 and at least one end wall 60 welded to, or otherwise impermeably integral with, the sidewall 52. Preferably, the end wall 60 is an enlarge plate that extends beyond the outer surface of side wall 52. This end wall 60 and sidewall 52 arrangement provides a suitable structure for mounting the chamber 50' withing the housing, as is shown in the figures and explained below.

The end wall 60 preferably includes a sealable opening 62 adapted for filling the sealed chamber 50' with a heat storage material 70. This configuration permits the manufacturer of the heater to assemble the chamber 50', with a sidewall 52 and end wall 60, prior to filling the chamber 50'. Further, this configuration permits the manufacturer to fill the chamber 50' after the entire heating assembly is assembled, prior to securing the assembly into the housing. Heat storage material 70 may be any medium suitable for storing heat, preferably comprising either silica or oil. In the preferred embodiment, the sealable opening 62 in the end wall 60 include an interior threaded portion 64 surrounding opening 62. Preferably, the opening 62 includes an extruded portion 66 which protrudes a distance into chamber 50', the extruded portion being threaded to at least partially define the threaded portion 64.

The threaded mating surface 64 is adapted to mate with a threaded plug 80, that is inserted to seal the opening 62. Threaded plug 80 may include a recess 82 at its outer end which is adapted to receive a driving tool (not shown), such as a hex-driver. In the preferred embodiment, a gasket material is applied to plug threading 84 to facilitate the sealing of the chamber 50'.

In the preferred embodiment, heating element 20 and sealed chamber 50' are in contact with a plurality of spaced heat transfer fins 90 which aid in transferring heat to the surrounding atmosphere. Heat transfer fins 90 are preferably rectangular plates of metal in a substantially parallel alignment to define a plurality of passageways 92 between heating element 20 and heat storage member 50. The heat transfer fins 90 also preferably extend beyond the element 20 and the heat storage member 50 to facilitate distribution of heat.

The heat transfer fins 90 are secured in place along the elongated element 20 and the chamber 50' generally transverse to the elongated axis of the element 20 and the chamber 50'. The plurality of fins 90 are generally evenly spaced and in parallel arrangement relative each other, and the element 20 and the chamber 50' pass through openings 91*a*, 91*b* of the fins 90. Prior to assembling the heating assembly, the first opening 91*a* of each fin is preferably formed as an opening that is slightly larger than the outer dimensions of the heating element 20, and the second opening 91*b* of each fill 90 is formed as an opening that is slightly larger than the outer dimension of the chamber 50'. After placing the fins in position, the fins are secured in position by mechanically distorting the metal of the fin 90 to distort the first opening 91*a* geometry to engage with the element outer surface, and to distort the second opening 91*b* geometry to engage with the outer surface of the chamber 50'.

In the preferred embodiment, a first gripping collar 94 surrounds the first opening 91*a* of each heat transfer fin 90, preferably formed by extruding a smaller opening to bend a portion of the fin material out of the plane of the fin. In this embodiment, the gripping collar 94 defines and borders the geometry of the first opening 91*a*, and is adapted to fit around heat emitting surface 22, loosely fitted for installing the fin in position along the length of the element 20. Once installed in position, an area of the fin is crimped or otherwise distorted to cause the gripping collar 94 to engage the outer surface 22 of the element 20. In one embodiment, the fin 90 is crimped at a first crimped portion 96 to distort the metal and bring the collar 94 into engagement with heat emitting surface 22. Other areas of the fin 90 may alternatively be crimped or otherwise distorted to perform the function of distorting the symmetry of the collar 94.

Similarly, a second gripping collar 98 surrounds the second opening 91*b* of each heat transfer fins 90, preferably by also extruding a smaller opening of the fin material out of the plane of the fin, to form a second opening 91*b* that is surrounded by, and has a geometry defined by, the second gripping collar 98. The geometry of the second opening 91*b* is such that it receives the chamber 50', the gripping collar loosely fitting around the chamber sidewall 52, for assembly, whereby subsequent deformation of the geometry of the second opening 91*b* causes the gripping collar 98 to engage with the outer surface of the chamber sidewall 52. One way of creating such a distortion of the second opening 91*b* is to crimp the metal of the fin adjacent the opening 91*b*, such as at crimped portion 100, to bring the second collar 98 into engagement with heat receiving surface 56.

One preferable means for crimping the metal of each fin 90 to distort the first opening 91*a* and the second opening 91*b* included a manufacturing operation whereby the fins 90 are bent along a line that transects at least a portion of the openings 91*a*, 91*b*. In this embodiment, each fin 90 has a cross-sectional shape that is slightly V-shaped. As a variation of this form of the invention, the fins 90 may be preformed in a V-shaped nature with apertures forming the openings 91*a*, 91*b*. In this form, the fins 90 may be inserted over the element 20 and the chamber 50' when applying force on the V-shaped formation of the fins, and metal spring-back (after removing such force) causes the metal of the fin to frictionally engage with the element 20 and the chamber 50'. This embodiment of the invention may even take the form of a series of inter-connected V-shaped fin segments, appearing in an overall accordion shape.

The heating assembly 18 is secured to the interior 14 of the housing 12 via at least one mounting member 30. The mounting member 30 has at least one flange 35 fastened to the interior 14 of the housing 12, and has a mounting surface 34 for receiving an outer surface 56 of the heat storage member 50, such that the heating assembly is at least supported by the heat storage member 50 being positioned on the mounting surface 34. The mounting member 30 preferably includes a mounting opening 36 which is adapted to receive an end portion 24 of heating element 20. In the preferred embodiment, this arrangement of mounting the heat storage member 50 on the mounting member 30 is the primary means of securing the entire heating assembly 18 in the housing. This arrangement provides secure attachment of the heating assembly 18 in the housing 12, without the need for insulated securing brackets on the heating element 20.

End wall 60 is preferably secured to heating element 20 and housing 12 via mounting member 30 and a fastener 32, although other suitable attachment means are contemplated and will be apparent from the present disclosure.

While the specific embodiments have been illustrated and described, numerous modifications come to mind without significantly departing from the spirit of the invention, and the scope of protection is only limited by the scope of the accompanying Claims.

We claim:

1. An electrical heating unit for warming atmosphere adjacent the unit comprising:

a housing having an interior space in fluid communication with the surrounding atmosphere;

a heating assembly positioned within the interior of said housing, the heating assembly comprising an electric heating element having an electrical current source selectively energized and de-energized by a means for controlling current and having an outer heat emitting surface; and, a heat storage member having a chamber with an outer surface adjacent the electric heating element, the outer surface of the heat storage member being positioned relative the heat emitting surface to receive heat transferred from the heating element when said element is energized and adapted to heat the content material of said member to heat said member, and said heat storage member being adapted to continue to disburse heat to the adjacent atmosphere subsequent to the electric heating element being de-energized as said content material cools, said content material being adapted to heat and cool without phase transition of its physical state.

2. An electrical heating unit according to claim 1, wherein the heat storage member is positioned in spaced relation to the electric heating element.

3. An electrical heating unit according to claim 2, further comprising a plurality of spaced heat transfer fins positioned within the interior of said housing, a first portion of each of said fins being adjacent the element, and a second portion of each of said fins being adjacent the heat storage member.

4. An electrical heating unit according to claim 3, wherein the plurality of heat transfer fins are aligned to define a plurality of passageways between the heating element and the heat storage member.

5. An electrical heating unit according to claim 4, wherein at least one of said plurality of heat transfer fins has a first gripping collar engaged with said heat emitting surface.

6. An electrical heating unit according to claim 4, wherein at least one of said plurality of heat transfer fins has a second gripping collar engaged with said heat storage member.

7. An electrical heating unit according to claim 4, wherein each of said plurality of fins comprises a first opening for receiving said heating element and a second opening for receiving said heat storage member, the second opening having a geometry which is different than the geometry of the outer surface of the heat storage member to maintain position of the fin by frictional engagement with the outer surface of the heat storage member.

8. An electrical heating unit according to claim 7, wherein the first opening has a geometry which is different than the geometry of the surface of the heating element to maintain position of the fin by frictional engagement with the outer surface of the heating element.

9. An electrical heating unit according to claim 3, wherein the heat transfer fins are comprised of generally v-shaped metal plates adapted to frictionally engage with either said element or said heat storage member.

10. An electrical heating unit according to claim 3, wherein the heat transfer fins are comprised of deformed metal plates adapted to frictionally engage either said element or said heat storage member with a spring force.

11. An electrical heating unit according to claim 3, wherein the heating assembly is secured to the housing by at least one mounting member, the mounting member having a mounting surface for receiving at least a portion of the outer surface of the heat storage member.

12. An electrical heating unit according to claim 11, wherein the mounting member further comprises a mounting opening, the heating element extending into the mounting opening.

13. An electrical heating unit according to claim 12, wherein the mounting member is secured to an end plate of the heat storage member by a fastener.

14. An electrical heating unit according to claim 1, wherein the content material is sand.

15. An electrical heating unit according to claim 1, wherein the content material oil.

16. An electrical heating unit according to claim 15, wherein the sealed chamber further comprises an end wall having a threaded opening adapted for filling the chamber with said medium and having a means for sealing said opening.

17. An electrical heating unit according to claim 16, wherein said means for sealing said opening comprises a threaded plug being threadedly engaged with a mating surface of the end wall.

18. An electrical heating unit according to claim 17, wherein said threaded plug has a recess suitable for inserting a driving tool.

19. An electrical heating unit for warming atmosphere adjacent the unit, comprising:

a means for generating heat from an electrical current source selectively energized and de-energized, such that said means for generating heat is ventilated to the adjacent atmosphere to emit heat when said current source is energized; and, a passive heat storing member having a chamber with an outer surface positioned adjacent and exposed to said member for generating heat, said heat storing member having a content material for storing heat emitted from the means for generating heat, and being adapted to disburse heat to the surrounding atmosphere when said means for generating heat is de-energized as said content material cools, said content material being a liquid adapted to heat and cool without phase transition of physical state.

20. An electrical heating unit according to claim 19, wherein the heat storing member comprises a sealed chamber containing sand.

21. An electrical heating unit according to claim 19, wherein said heat storing material comprising oil.

22. An electrical heating unit for warming atmosphere adjacent the unit comprising:

a housing having a length and a plurality of apertures along a portion of the housing for allowing air flow between an interior and an exterior of the housing;

an elongated electric heating element positioned within the interior of said housing along an extent of the housing length, the heating element having an outer surface being adapted to emit heat when energized by an electrical current source; and, a plurality of heat transfer fins disposed along an extent of the element, each said fin having an opening dimensioned to receive the element and a gripping collar adapted to frictionally engage with the outer surface of the element for maintaining said fin in place.

23. An electrical heating unit according to claim 22, further comprising an elongated heat storage member positioned generally parallel to said element and whereing the heat storage member comprises a sealed chamber containing a heat storage material.

24. An electrical heating unit according to claim 23, wherein said heat storage material is oil.

25. An electrical heating unit according to claim 23, wherein said plurality of spaced heat transfer fins have a second opening dimensioned for receiving the heat storage member and having a second gripping collar adapted to engage with an outer surface of said heat storage member.

* * * * *